US010407951B2

(12) United States Patent
Götzen et al.

(10) Patent No.: US 10,407,951 B2
(45) Date of Patent: Sep. 10, 2019

(54) REINFORCED MOTOR VEHICLE LOCK

(75) Inventors: Klaus Götzen, Mülheim (DE); Alexander Grossmann, Essen (DE); Dorothea Müller, Essen (DE)

(73) Assignee: Kiekert AG, Heiligenhaus (DE)

( * ) Notice: Subject to any disclaimer, the term of this patent is extended or adjusted under 35 U.S.C. 154(b) by 901 days.

(21) Appl. No.: 13/997,357

(22) PCT Filed: Dec. 10, 2011

(86) PCT No.: PCT/DE2011/002108
§ 371 (c)(1),
(2), (4) Date: Jul. 2, 2014

(87) PCT Pub. No.: WO2012/083924
PCT Pub. Date: Jun. 28, 2012

(65) Prior Publication Data

US 2015/0145262 A1 May 28, 2015

(30) Foreign Application Priority Data

Dec. 22, 2010 (DE) ..... 10 2010 063 868

(51) Int. Cl.
*E05B 77/10* (2014.01)
*E05B 79/02* (2014.01)
(Continued)

(52) U.S. Cl.
CPC ..... *E05B 85/20* (2013.01); *E05B 77/10* (2013.01); *E05B 79/08* (2013.01); *E05B 79/20* (2013.01);
(Continued)

(58) Field of Classification Search
CPC ..... Y10T 292/1043; Y10T 292/1045; E05B 85/02; E05B 85/20; E05B 77/10;
(Continued)

(56) References Cited

U.S. PATENT DOCUMENTS 5,150,933 A * 9/1992 Myslicki ..... E05B 83/16 292/216
5,172,946 A * 12/1992 Dowling ..... E05B 83/16 292/216
(Continued)

FOREIGN PATENT DOCUMENTS

DE 102007049078 A1 * 4/2009 ..... E05B 77/10
EP 0982978 A2 * 3/2000 ..... E05B 85/02
(Continued)

OTHER PUBLICATIONS

International Search Report for corresponding patent application No. PCT/DE2011/002108 dated Jun. 18, 2012.
(Continued)

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The invention relates to a motor vehicle lock, comprising a lock housing, a lock case, a locking mechanism and an operating device, wherein at least one component of the operating device extends through an opening in the lock housing and said opening is designed with at least one reinforcing insert. The main area of the plate or the metal sheet from which the lock case is made is basically relatively large. In light of this, it has proved advantageous to form the reinforcing insert from the lock case. Waste is thus avoided.

9 Claims, 7 Drawing Sheets

Figure 1:
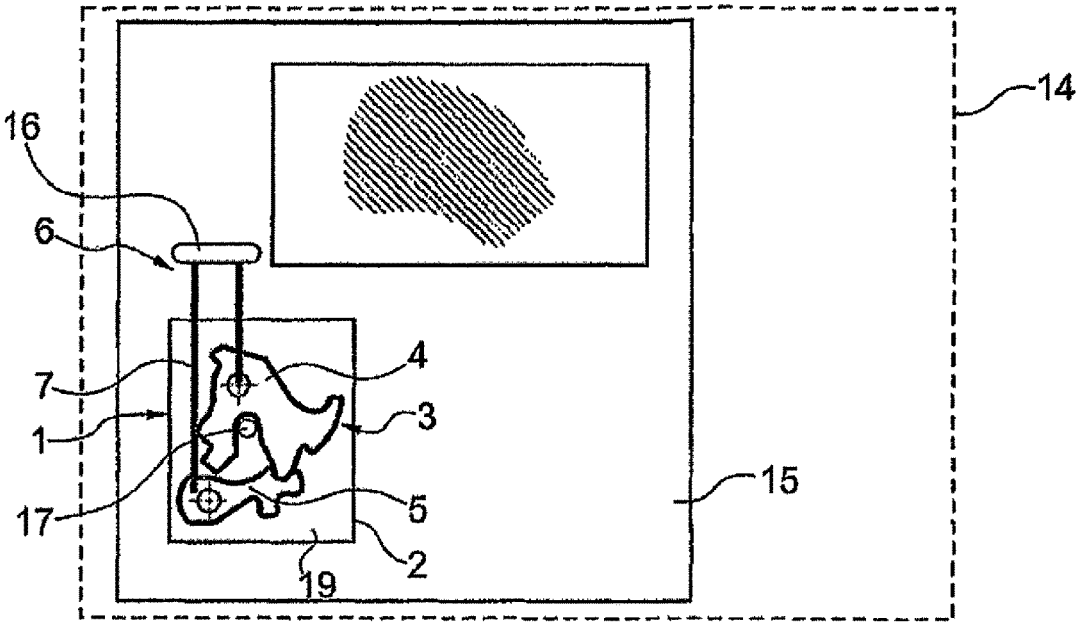

(51) Int. Cl.

| | |
|---|---|
| ***E05B 79/04*** | (2014.01) |
| ***E05B 79/06*** | (2014.01) |
| ***E05B 79/08*** | (2014.01) |
| ***E05B 79/20*** | (2014.01) |
| ***E05B 85/02*** | (2014.01) |
| ***E05B 85/20*** | (2014.01) |

(52) U.S. Cl.
CPC ..... *E05B 85/02* (2013.01); *E05B 79/02* (2013.01); *E05B 79/04* (2013.01); *E05B 79/06* (2013.01); *Y10T 292/108* (2015.04); *Y10T 292/1043* (2015.04); *Y10T 292/1045* (2015.04); *Y10T 292/1046* (2015.04); *Y10T 292/1047* (2015.04); *Y10T 292/1082* (2015.04)

(58) Field of Classification Search
CPC ..... E05B 79/08; E05B 79/00; E05B 79/02; E05B 79/04; E05B 79/06; E05B 79/10; E05B 79/20; E05B 9/00; E05B 9/002; E05B 2009/004; E05B 9/02
USPC ..... 292/194, 201, 216, DIG. 23, 1, DIG. 53, 292/DIG. 54, DIG. 14
See application file for complete search history.

(56) References Cited

U.S. PATENT DOCUMENTS

| | | | | | |
|---|---|---|---|---|---|
| 5,308,128 | A * | 5/1994 | Portelli | E05B 77/265 | 292/216 |
| 5,350,206 | A * | 9/1994 | Akahori | E05B 63/0056 | 292/336.3 |
| 5,490,434 | A * | 2/1996 | Osborn | B60K 17/352 | 74/473.1 |
| 5,531,489 | A * | 7/1996 | Cetnar | E05B 85/12 | 292/225 |
| 5,582,449 | A * | 12/1996 | Weyerstall | E05B 85/02 | 292/216 |
| 5,676,003 | A * | 10/1997 | Ursel | E05B 77/26 | 292/201 |
| 5,744,769 | A * | 4/1998 | Proctor | B60Q 1/1469 | 200/4 |
| 6,109,674 | A * | 8/2000 | Bartel | E05B 81/06 | 292/201 |
| 6,349,611 | B1 * | 2/2002 | Nagle | B62D 1/184 | 74/493 |
| 6,412,834 | B1 * | 7/2002 | Waitai | E05C 3/10 | 292/194 |
| 6,422,616 | B1 * | 7/2002 | Wortmann | E05B 83/24 | 292/214 |
| 6,463,773 | B1 * | 10/2002 | Dimig | E05B 83/36 | 292/201 |
| 6,705,140 | B1 * | 3/2004 | Dimig | E05B 81/06 | 292/201 |
| 6,848,286 | B2 * | 2/2005 | Dimig | E05B 83/36 | 292/201 |
| 7,053,639 | B1 * | 5/2006 | Fyfield | G01R 31/311 | 324/750.22 |
| 7,059,639 | B2 * | 6/2006 | Gates | E05B 83/16 | 292/125 |
| 7,216,901 | B2 * | 5/2007 | Miyagawa | F16C 1/107 | 292/225 |
| 8,789,860 | B2 * | 7/2014 | Beck | E05B 77/10 | 292/201 |
| 2002/0167177 | A1 * | 11/2002 | Erices | E05B 77/04 | 292/201 |
| 2007/0210588 | A1 * | 9/2007 | Cetnar | E05B 77/26 | 292/216 |
| 2008/0157546 | A1 * | 7/2008 | Vitry | E05B 5/00 | 292/226 |
| 2010/0117379 | A1 * | 5/2010 | Mitchell | E05B 77/06 | 292/216 |
| 2010/0194121 | A1 * | 8/2010 | Konomoto | E05B 85/26 | 292/216 |
| 2010/0236305 | A1 * | 9/2010 | Beck | E05B 77/10 | 70/237 |
| 2011/0309642 | A1 * | 12/2011 | Shimizu | E05B 83/30 | 292/336.3 |
| 2012/0132657 | A1 * | 5/2012 | Seiders | B65D 81/3816 | 220/592.2 |
| 2014/0203570 | A1 * | 7/2014 | Nass | E05B 79/20 | 292/196 |
| 2015/0042104 | A1 * | 2/2015 | Hernandez | E05B 85/02 | 292/2 |
| 2015/0197966 | A1 * | 7/2015 | Regnault | E05B 77/04 | 292/200 |
| 2018/0274272 | A1 * | 9/2018 | Woo | E05B 85/26 | |

FOREIGN PATENT DOCUMENTS

| | | |
|---|---|---|
| EP | 2195499 | 6/2010 |
| FR | 2 778 198 A1 | 11/1999 |
| JP | S61-98164 | 6/1986 |
| JP | 7-33723 | 6/1995 |
| JP | 2004-244892 | 9/2004 |
| WO | 2008/104073 A1 | 9/2008 |
| WO | 2009/049588 A2 | 4/2009 |

OTHER PUBLICATIONS

International Preliminary Report on Patentability and Written Opinion for corresponding patent application No. PCT/DE2011/002108 dated Jun. 25, 2013.
Website post, Red66gt, DIY Rear Door Lock Actuator, www.benzworld.org/forums/w210-e-class/1455824-diy-w210-rear-door-lock-actuator-2.html.
English Translation of Notification of Reasons for Refusal in counterpart Japanese Patent Application No. 2013-545044, dated Oct. 23, 2015.

* cited by examiner

REINFORCED MOTOR VEHICLE LOCK

The invention relates to a lock, in particular a motor vehicle lock, comprising a lock housing, a lock case, a locking mechanism and an operating device, wherein at least one component of the operating device extends through an opening in the lock housing and said opening is designed with at least one reinforcing insert.

A motor vehicle lock serves to lock motor vehicle doors, tailgates and similar. For locking the door, the motor vehicle lock comprises a locking mechanism with a rotary latch and a pawl. The rotary latch and pawl are arranged in such a way that they can accommodate a striker fixed on the car body side in their locked position and can lock it in place. The pawl has the task of locking the rotary latch in this position.

The rotary latch and pawl are normally rotatably fixed to a lock case generally made from metal. In many cases the lock case provides other functions and can, for instance, serve to fix a lock in a door or tailgate of a motor vehicle. Also, other components or parts can be attached to the lock case, such as a rotatably mounted blocking lever, which can block the pawl in its engaged position. Usually, there is also a reinforcement plate, generally also made of metal, serving to provide an additional rotatable fixing of the rotary latch and/or pawl. The rotary latch and the pawl are generally located between the lock case and the reinforcing plate. As the reinforcing plate generally only serves to improve the fixing of the rotary latch and/or pawl, the main area is normally small compared to the main area of the lock case.

As the components of a motor vehicle lock generally have to be protected against dust and water, a motor vehicle lock normally contains a lock housing covering one or several components of the motor vehicle lock. The lock housing is often closed off with a cover plate to further improve the desired protection for said components. The lock housing and the cover plate are preferably made from plastic for weight reasons.

An operating device of such a motor vehicle lock serves to open the locking mechanism. Such an operating device can contain a Bowden cable. The Bowden cable core can extend through an opening in the lock housing, as described in publication WO 2009/049588 A2.

The lock of the invention can include one, several or all of the above characteristics of a lock. Any combination is possible.

A locking mechanism of a motor vehicle can be exposed to increased forces, in particular, during a side impact, for instance when an external door panel is pressed against the housing, causing considerable deformation. In extreme cases this can block the locking mechanism so that the respective motor vehicle door can only be opened with great effort. It therefore has already been suggested to provide the motor vehicle lock with reinforcing elements to improve crash safety, e.g. in form of reinforcing plates connected to the housing. To further increase operational safety during a crash, WO 2009/049588 A2 discloses that the aforementioned opening in the lock housing is, in addition, equipped with a reinforcing insert in form of a suitable elongation of the reinforcing plate.

The invention has the task of providing a reliably operating motor vehicle lock that can be produced with little production effort.

To solve this task the motor vehicle lock contains the characteristics of claim 1. Advantageous embodiments are described in the sub claims.

To solve the task, the motor vehicle lock is provided with a lock housing, a lock case, a locking mechanism and an operating device, wherein at least one component of the operating device, in particular the core of a Bowden cable, extends through an opening in the lock housing. This opening contains a reinforcing insert to provide a good level of operational reliability. The reinforcing insert is part of the lock case.

The main area of the plate or of the metal sheet from which the lock case is made, is basically relatively large. In light of this it has proved advantageous to form the reinforcing insert from the lock case in order to minimise or even completely avoid waste during production. The reinforcing insert and lock case are thus connected, forming a single part.

To machine the lock case out of the main area of the plate or the metal sheet, the plate or metal sheet is first suitably punched, drilled and/or milled. The punched plate or metal sheet is then bent to produce the lock case with the reinforcing insert. The waste created by the punching is at most increased slightly by the provision of a reinforcing insert.

The lock case generally contains one or two side walls forming a right angle with the main area of the lock case. The side walls serve, amongst other things, to protect the locking mechanism attached to the main area and to fix the lock. The side wall or the side walls extend up to the level of the reinforcing insert. Where the lock case contains two side walls, the reinforcing insert is located between two end sections of the side walls. The side wall or side walls protect the reinforcing insert against undesired external mechanical stresses, such as impact loads. This further improves operational reliability.

The reinforcing insert is preferably connected to the main area of the lock case by means of a web. Such a connection between the main area and the reinforcing insert has shown to be sufficiently strong. The reinforcing insert and web only insignificantly increase the total weight of the lock case.

The reinforcing insert preferably has the shape of a fork or U, allowing a Bowden cable to be easily secured.

The lock case including the reinforcing insert is generally made of metal to provide a mechanically stable basis for the lock. The lock housing is generally made of plastic to keep its weight to a minimum and protect against soiling and similar.

The reinforcing insert is generally arranged inside the lock housing or inside a double wall of the lock housing and is, in particular, connected to the lock housing by a snap-in connection. Externally, the lock resembles a conventional lock and can therefore be handled like conventional locks.

The thickness of the lock case is preferably greater than the thickness of a reinforcing plate of the motor vehicle lock. The forces generated during operation can thus be expediently predominantly absorbed by the lock case. Also, the opening is thus particularly advantageously reinforced, producing a particularly high level of operational reliability.

The lock case is therefore preferably produced from a 1.5 mm to 3 mm thick plate, made in particular of steel. The reinforcing plate is therefore preferably produced from a 0.5 mm to 2 mm thick plate, made in particular of steel. The thickness of the lock case is then 1.5 mm to 3 mm, e.g. for instance 2 mm and the thickness of the reinforcing plate 0.5 mm to 2 mm, e.g. for instance 1.5 mm.

The reinforcing plate is in particular U-shaped and does consequently not contain the extension known from WO 2009/049588 A2, serving to reinforce the opening of the lock housing.

Below the invention and the technical background are explained in detail with reference to the figures. It should be pointed out that the figures show particularly preferred embodiments of the invention, although the invention is not limited to these. The drawings show:

FIG. 1: a schematic diagram of a motor vehicle with a door

Figure 2:
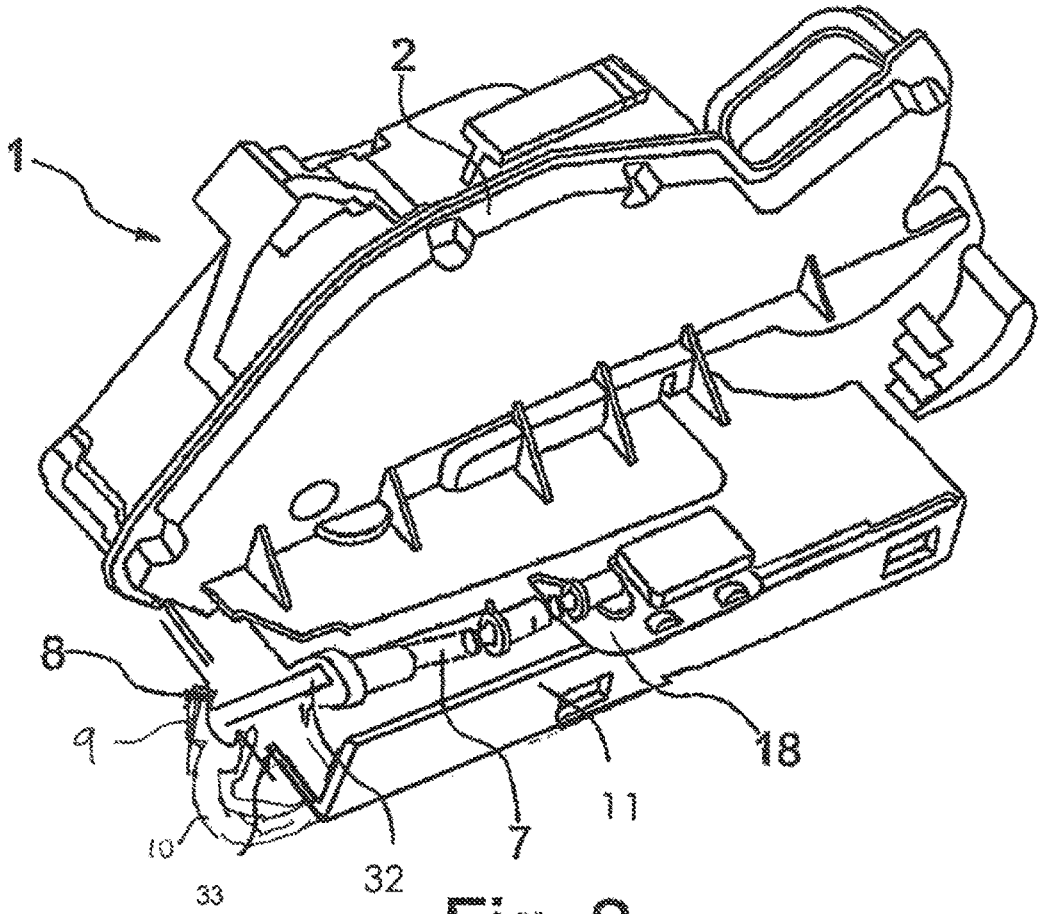

FIG. 2 a perspective view of a motor vehicle lock

Figure 3:
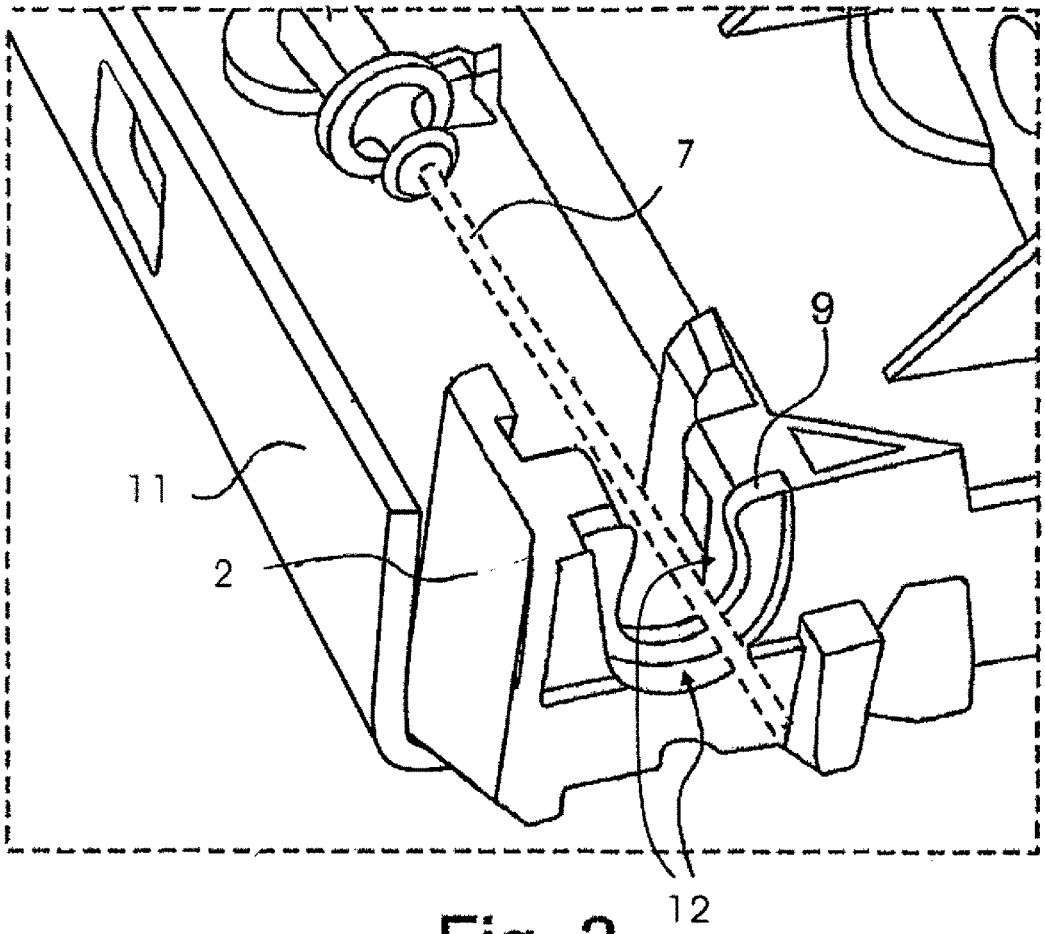

FIG. 3: a section of a motor vehicle lock

Figure 4:
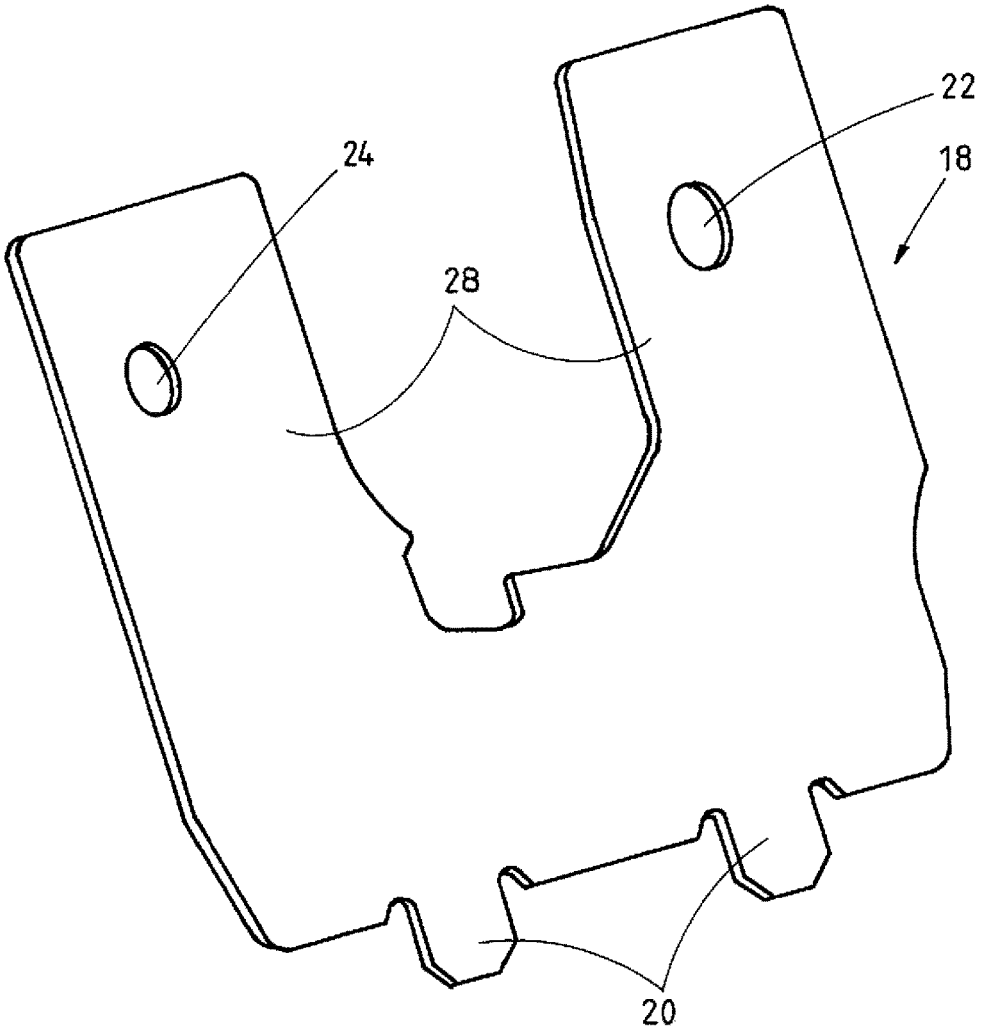

FIG. 4: a reinforcing plate

Figure 5:
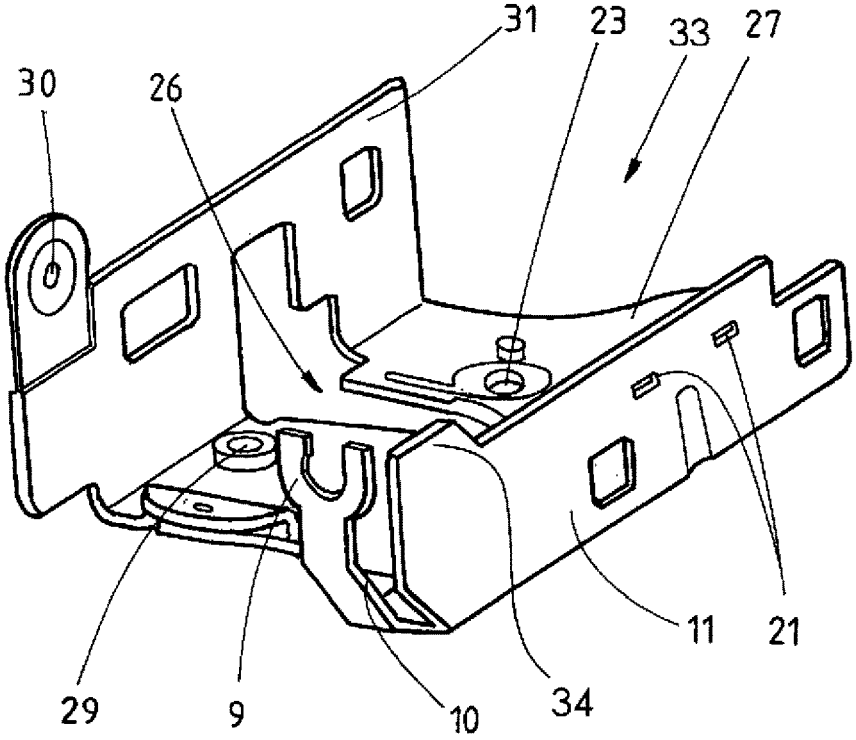

FIG. 5: a lock case

Figure 6:
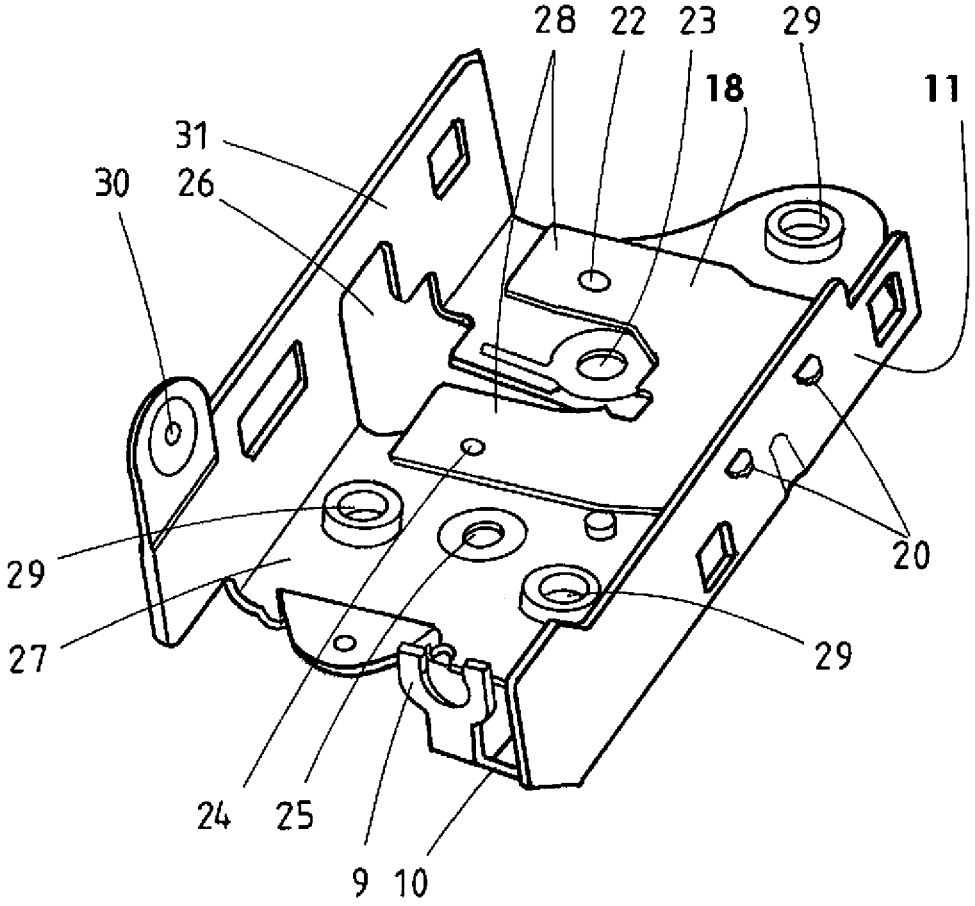

FIG. 6: a lock case with reinforcing plate

Figure 7:
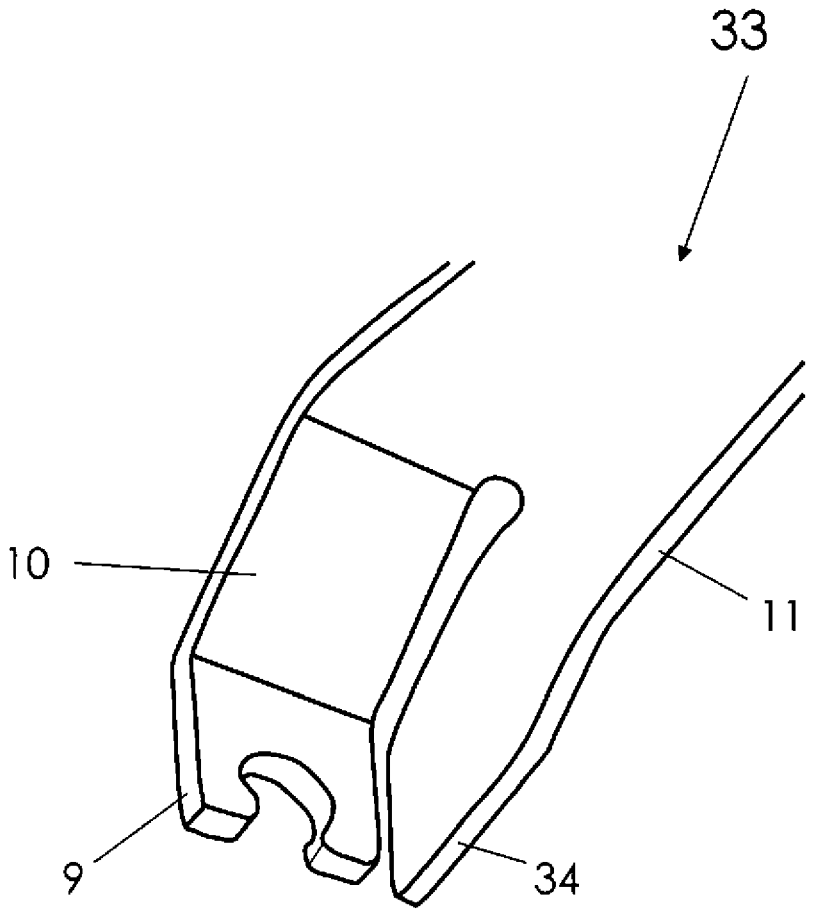

FIG. 7: a section of the lock case with reinforcing insert

FIG. 1 shows a schematic view of a motor vehicle 14 with a door 15, containing a motor vehicle lock 1. In known arrangements, such a motor vehicle lock 1 can be operated via a door handle 16 on the door 15 with the operating action being transferred to the locking mechanism 3 via an operating device 6. The operating device 6 can generally be designed as a lever. A Bowden cable 7 is shown as an example.

The operating device 6 extends into an interior 19 of the indicated lock housing 2 where the locking mechanism 3 is arranged, containing a rotary latch 4 and a pawl 5. In the shown position, the rotary latch 4 accommodates a striker 17 fixed on the body side and said latch is blocked from moving by the engaging pawl 5. With the aid of the Bowden cable 7, an opening movement of the door handle 16 can be transferred to the pawl 5 in such a way that the pawl is moved out of the shown engaged position.

FIG. 2 shows a perspective view of an embodiment of a motor vehicle lock 1, with the encapsulated lock housing 2 being visible. The bottom left section of the motor vehicle lock 1 contains an indicated opening 8, in which a Bowden cable 7 is guided or fixed by a mounting 32. The opening 8 is arranged in a part of the lock housing 2 made of plastic. The mounting 32 is inserted in the U- or Omega-shaped opening 8, with a provided reinforcing insert 9 (see in particular FIG. 6) ensuring the fixing of the mounting 32 even when exposed to extreme forces. In FIG. 2, the reinforcing insert 9 is not shown for reasons of clarity. The reinforcing insert 9, shown for instance in FIG. 6, is connected by means of a web 10, also shown in FIG. 6, to the lock case 33, forming a single part and has been machined from an approx. 2 mm thick plate or has been produced by bending and cutting, milling and/or drilling. An approx. 1.5 mm thick steel reinforcing plate 18 is located above the steel lock case 33 and is in this embodiment partly arranged on the lateral surface 11 of the lock case 33. Protruding teeth of the side wall 11 extend trough openings in the reinforcing plate 18 in the embodiment shown in FIG. 2. This contributes to fixing the reinforcing plate 18, which, however, protrudes from the side wall 11 for this reason. The Bowden cable 7 is arranged above the reinforcing plate 18. Both legs of the U-shaped reinforcing plate 18 run parallel to the main area of the lock case 33, enclosing a right angle with the lateral surface 11 of the lock case.

In a perspective view from a different direction, FIG. 3 shows a section of the Bowden cable 7 of the operating device, extending through said opening of the lock housing 2, arranged in the two walls or double wall 12 of the lock housing 2 or a double wall 12. During normal operation, the Bowden cable core is moved to and fro in its direction of extension and is acted upon with a certain force. As a result, the opening, in particular, can be exposed to particularly high forces and especially due to a high permanent load and/or and excessively high force. In order to ensure a permanent and accurate fixing inside the lock housing 2, the reinforcing insert 9 is provided in the area of the opening with the adjacent wall sections 12, essentially forming a same opening or seat for the Bowden cable 7. In order to provide a stable connection between lock housing 2 and the reinforcing insert 9 during operation, the reinforcing insert 9 is located between the two walls 12 of the lock housing 2. The reinforcing insert 9 is preferably retained in its engaged form by the two walls 12. The reinforcing insert 9 extends downwards in the direction of web 10, shown for instance in FIG. 5 and is connected to said web to form a single part.

FIG. 4 shows a preferred embodiment of a 1.5 mm thick U-shaped reinforcing plate 18 with legs 28 made preferably of steel or another metal. Laterally protruding journals 20 allow engagement in a side wall 11 of a lock case 33, preventing lateral protruding of the reinforcing plate. A hole 22 in a leg 28 of the U-profile accommodates the rotation axis of the rotary latch. Preferably, the hole has a relatively large diameter, as the diameter of the rotary latch axis generally is relatively large. A further hole 24 in another leg 28 of the U-profile accommodates the rotation axis of the pawl. The hole 24 preferably has a relatively small diameter, as the diameter of the pawl axis is generally relatively small.

FIG. 5 shows a lock case 33 in which a main area 27 is enclosed by a side wall 11. The side wall 11 contains two recesses 21 for accommodating the journals 20 of the reinforcing plate 18 shown in FIG. 4. The hole 23 in the main area 27 has a relatively large diameter and provides a rotatable mounting of the rotary latch axis. A hole 30 in another side wall 31 of the lock case 13 can be used to fix a motor vehicle lock to a door or tailgate or for other fixing purposes. The main area 27 contains a plurality of orifices 29 preferably with an internal thread for securing the motor vehicle lock to a door or tailgate. The arrangement also contains an intake slot 26 for the striker, extending from the main area 27 into the other side wall 31. A web 10 connects the main area 27 with the reinforcing insert 9. The side wall 11 contains a ridge 34 of equal height as the reinforcing insert 9 when viewed from the main area 27. This end section with the ridge 34 has a shape corresponding to the shape of web 10 and reinforcing insert 9. The reinforcing insert 9 is thus protected by the side wall 11 and in particular by the section of the side wall with the ridge 34. The reinforcing insert 9 is arranged between the two end sections of the two side walls 11 and 31.

FIG. 6 shows how the reinforcing plate 18 is being retained in the side wall 11 of the lock case 33 and the extension of the legs 28, parallel to the main area 27. The figure also shows a hole 25, for the rotatable mounting of the rotation axis of the pawl. The locking mechanism not shown in FIG. 6 is located between the main area 27 of the lock case and the reinforcing plate 18.

FIG. 7 shows an enlarged view of the reinforcing insert 9 viewed from a different perspective (into the partially shown lock case 33). FIG. 7 shows how a metal sheet has to be punched and bent to produce, amongst other things, the reinforcing insert 9 and web 10 from the sheet metal.

REFERENCE NUMBER LIST

1 Motor vehicle lock
2 Lock housing
3 Locking mechanism
4 Rotary latch
5 Pawl
6 Operating device
7 Bowden cable
8 Opening
9 Reinforcing insert
10 Web of lock case

11 Lock case-side wall
12 Double wall
13 Lock case
14 Motor vehicle
15 Door
16 Door handle
17 Striker
18 Reinforcing plate
19 Interior
19 Leg of U-shaped reinforcing plate
20 Protrusions or journals of reinforcing plate
21 Recesses in side wall des lock case
22 Opening for rotatable mounting of rotary latch axis
23 Opening for rotatable mounting of rotary latch axis
24 Opening for rotatable mounting of pawl axis
25 Opening for rotatable mounting of pawl axis
26 Intake slot of lock case
27 Main area of lock case
28 Leg of reinforcing plate
29 Opening with internal thread
30 Hole
31 Side wall
32 Mounting
33 Lock case
34 Side wall ridge

The invention claimed is:

1. A motor vehicle lock comprising:

a lock housing, a lock case that receives the lock housing, a locking mechanism and an operating device, wherein at least one component of the operating device exits the lock housing through an opening in the lock housing;

said lock case includes a main area and a reinforcing insert that is directly connected to the main area of the lock case and directly extends from the main area of the lock case and through a portion of the lock housing at the opening where the component of the operating device exits the lock housing; and a reinforcing plate for a rotatable fixing of a rotary latch and/or pawl of the locking mechanism, the reinforcing plate being a separable part from the lock case and is positioned orthogonal to side walls of the lock case;

wherein the lock housing has a double wall portion comprising two parallel wall sections that form the opening, and the reinforcing insert extends between and parallel to the parallel wall sections of the double wall portion of the lock housing to reinforce the lock housing at the opening.

2. Lock according to claim 1, wherein the lock case contains two side walls each extending at a right angle on opposite sides of the main area of the lock case and which extend up to the reinforcing insert in such a way that the reinforcing insert is located between two end sections of the side walls, and wherein the lock housing is received in the lock case between the side walls.

3. Lock according to claim 2, wherein a side wall adjacent to the reinforcing insert contains a ridge which extends at least as high from the main area as the reinforcing insert.

4. Lock according to claim 1, wherein the reinforcing insert includes a web that provides the direct connection to the main area of the lock case.

5. Lock according to claim 1, wherein the reinforcing insert has the shape of a fork or U.

6. Lock according to claim 1, wherein the lock case including the reinforcing insert is made of metal and/or the lock housing is made of plastic.

7. Lock according to claim 1, wherein a thickness of the reinforcing plate is thinner than a thickness of the lock case and in which the reinforcing plate is U-shaped.

8. Lock according to claim 1, wherein the component of the operating device is a Bowden cable.

9. Lock according to claim 1, wherein the lock case is provided with one or several threads and/or one or several holes for fixing in a door or tailgate.

* * * * *